US007994924B2

(12) United States Patent
Brandt et al.

(10) Patent No.: US 7,994,924 B2
(45) Date of Patent: Aug. 9, 2011

(54) RFID TAG BASED DISCRETE CONTACT POSITION INDICATION

(75) Inventors: David Dale Brandt, New Berlin, WI (US); Wayne H Wielebski, New Berlin, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 333 days.

(21) Appl. No.: 12/242,053

(22) Filed: Sep. 30, 2008

(65) Prior Publication Data

US 2010/0079289 A1 Apr. 1, 2010

(51) Int. Cl.
*G08B 13/14* (2006.01)

(52) U.S. Cl. ..... 340/572.7; 340/572.1

(58) Field of Classification Search ..... 340/572.1, 340/572.7, 10.1, 540; 235/492, 441, 487
See application file for complete search history.

(56) References Cited

U.S. PATENT DOCUMENTS

| | | | | |
|---|---|---|---|---|
| 6,343,744 | B1 | 2/2002 | Shibata et al. | |
| 6,863,220 | B2 * | 3/2005 | Selker | 235/492 |
| 2003/0116634 | A1 | 6/2003 | Tanaka | |
| 2007/0222697 | A1 * | 9/2007 | Caimi et al. | 343/861 |
| 2009/0101720 | A1 * | 4/2009 | Dewan et al. | 235/492 |

FOREIGN PATENT DOCUMENTS

| | | | |
|---|---|---|---|
| DE | 19645083 | A1 | 5/1998 |
| WO | 2008128963 | A1 | 10/2008 |

OTHER PUBLICATIONS

European Search Report mailed May 17, 2010.

* cited by examiner

*Primary Examiner* — Toan N Pham
(74) *Attorney, Agent, or Firm* — Fletcher Yoder LLP; Alexander R. Kuszewski; John M. Miller

(57) ABSTRACT

An RF based state indicator for indicating the state of a control device is provided. The RF-based state indicator indicates the position of a control mechanism by using the position of the control mechanism to enable or disable an RF tag. An RF reader acquires RF transmitted data from enabled RF tags and uses the data to indicate or control an operation aspect of a device.

26 Claims, 5 Drawing Sheets

RFID TAG BASED DISCRETE CONTACT POSITION INDICATION

BACKGROUND

The invention relates generally to the field of switches and similar devices used to control application of power to electrical loads. More particularly, the invention relates to the use of radio frequency identification (RFID) tags to indicate the state of an input device, such as a pushbutton, an electrical contact, a relay or contactor, and so forth.

In the field of electronics, a wide range of control devices is used for controlling the delivery of power to a load. Such control devices may include various switches, relays, contactors and disconnects to control load power, circuit breakers to protect electrical circuits from overload, and pushbuttons and selector switches to facilitate user control of power circuit operation. Additionally, a variety of electrical devices are known and currently available for indicating the state of a control device. For example, an auxiliary contact is often coupled to a contactor so that the auxiliary contact produces an auxiliary signal, a low power electrical signal that indicates whether the contactor is open or closed. The auxiliary signal may be coupled, as an input signal, to other components within a power control or monitoring system. For example, the auxiliary signal may be used to turn on or off an indicator light, or some other component within the power electronics system.

As power control systems and the logic required to control these systems become more complex, the number of state indicators increases, and the wiring coupled to the state indicators also increases. The increased wiring, in turn, leads to increased costs due to hardware requirements, connection labor and wiring maintenance. For example, control devices are often disposed within and on the doors of metal enclosures for load control purposes, with wires running between the door-mounted devices and internal devices. An increase in the number of wires increases maintenance problems due to wiring failure and inconvenient tethering of door-mounted devices with internal devices. Additionally, because there is a limit to how many wires can be placed under the common screw-terminal connectors, hardware is often added to control devices in the form of additional contacts driven by a mechanical or electromechanical shaft called an operator. Furthermore, each electrical connection creates the potential for vibration induced failure. Therefore, labor, maintenance and material costs could be reduced if the discrete wired state indicators could be replaced with wireless state indicators.

The use of wireless state indicators, however, presents the difficulty of finding a suitable power supply. Often times a power supply is not available from the control device. Even when power is available, in the form of load power, the conversion from high voltage to low voltage adds additional cost. Batteries, on the other hand, incur additional maintenance costs due to the need for frequent replacement, and large batteries may interfere with control devices housed within the limited space of the metal enclosures. Furthermore, power scavenging techniques (based on vibration, or light or thermal gradients) typically provide too little power to achieve suitable control update rates, are too large, or depend on unreliable sources.

Therefore, it may be advantageous to provide an improved state selection or indicator device. In particular, it may be advantageous to provide a state selection or indicator device that communicates wirelessly and employs a power supply that is reliable, maintenance free, and allows acceptable control update rates.

BRIEF DESCRIPTION

Embodiments of the present invention use RFID tags as binary state indicators to indicate the state of power control devices and user input indications. An embodiment of an RFID tag, in accordance with the present invention, includes an RFID chip, which contains identification information and an RF antenna that is selectively coupled to or decoupled from the RFID chip to indicate the binary state of a power control device. An embodiment of a control system, in accordance with the present invention, includes one or more RFID tag readers electrically coupled to load control circuitry and one or more RFID tags in wireless communication with the RFID tag readers to effect changes in the state of the loads.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
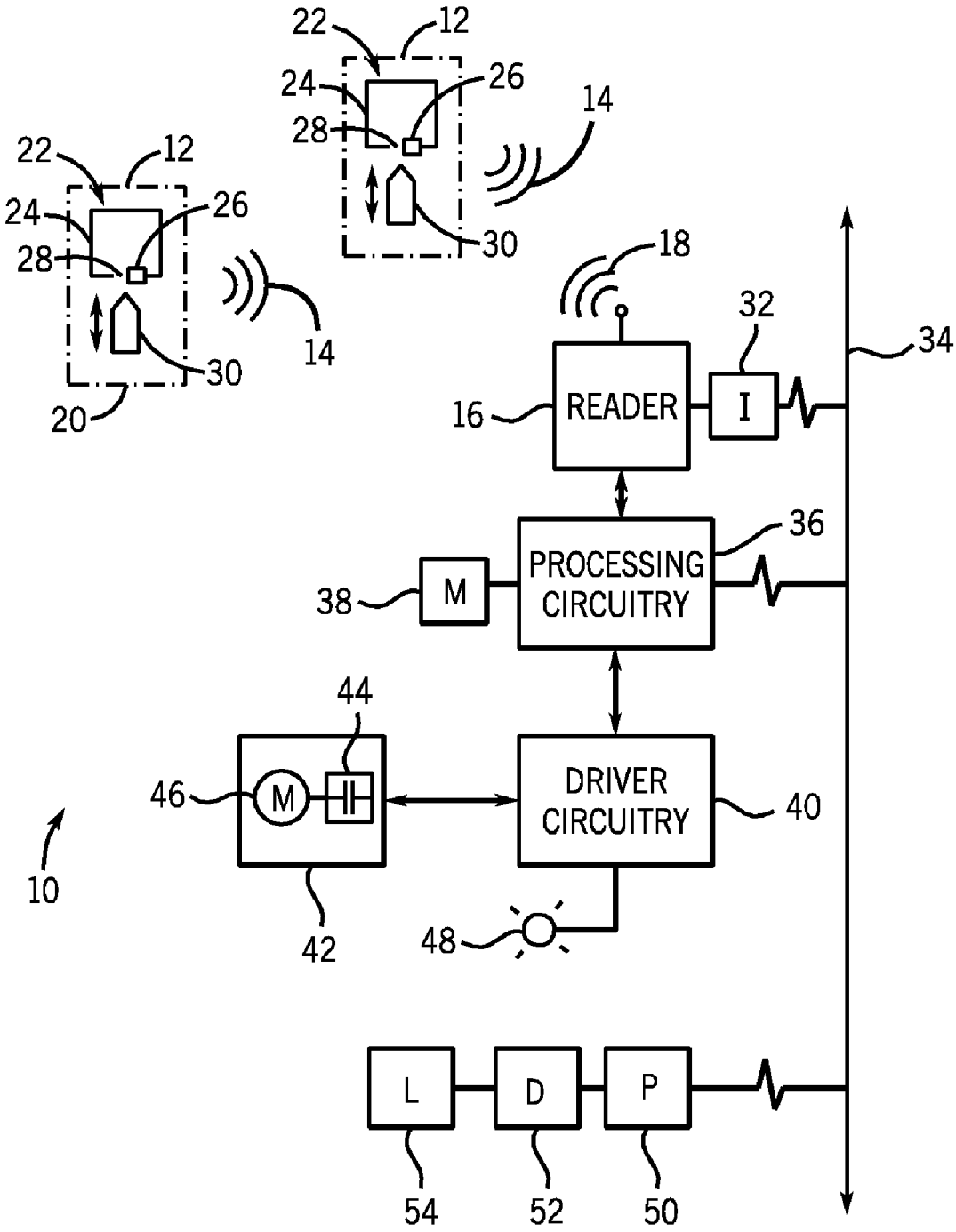
FIG. 1 is a block diagram of an exemplary control system having a plurality of components, e.g. RFID tag reader, RFID state indicators, motors, etc.

Turning now to the drawings, and referring first to FIG. 1, an exemplary control system is illustrated and designated generally by reference numeral 10. The control system 10 may include a plurality of RFID state selectors or indicators 12 (referred to herein simply as state indictors). Although FIG. 1 depicts two RFID state indicators, it should be noted that the present invention is not limited to any particular number of RFID state indicators. In embodiments of the present invention, the RFID state indicators 12 are input devices used to facilitate user control of some operational aspect of the control system 10, as will be explained below. In other embodiments, the RFID state indicators 12 are coupled to components within the control system 10 such as to provide an indication of the operational state of the control system 10.

Also included in the control system 10 is a reader 16. The reader 16 may be any device known to those of ordinary skill in the art for communicating with, or "reading," RFID tags. Readers are also commonly known as interrogators. The reader 16 iteratively acquires data from the RFID state indicators 12, by transmitting a power/interrogation signal 18. As described below, the RFID state indicators 12 may or may not emit a return signal 14 to the reader 16 in response to the power/interrogation signal 18. The detection or non-detection of a return signal 14 corresponding with each RFID state indicator 12 informs the reader 16 of the binary state of each RFID state indicator 12.

The RFID state indicator 12 includes an RFID tag 22. The RFID tag 22 includes an antenna 24 and a circuit 26. The antenna 24 is both a receiving antenna and a transmitting antenna, designed to resonate at a particular frequency that corresponds with the communication frequency or frequencies of the reader 18. The electrical energy received by the antenna 24 from the reader 16 through the power/interrogation signal 18 serves to power the circuit 26. In certain embodiments of the present invention, the circuit 26 that holds a small amount of coded information, such as, for example, identification data, make and model, year of manufacture, etc. The circuit 26 is considered "passive" in that it does not have an independent power source and it does not initiate transfer of the information except in response to the signals from reader 16. If the circuit 26 is coupled to the antenna 24, the power/interrogation signal 18 from the reader 16 will power the circuit 26 and cause the circuit 26 to generate a control signal encoded with the data stored on the circuit 26.

The RFID state indicator 12 also includes an operator 30, which selectively couples or decouples the antenna 24 from the circuit 26 (or that completes a circuit required to define the antenna). Whether the RFID tag 22 emits a return signal in response to the power/interrogation signal 18 depends on the state of the operator 30. In certain embodiments of the present invention, the RFID tag 22 is normally open, as shown in FIG. 1. As such, the antenna 24 is decoupled from the circuit 26 by an interruption 28, a small insulative gap on one side of the circuit 26. The interruption 28 causes the circuit 26 to be inoperative. In the embodiment illustrated, the interruption actually opens the loop required to form the antenna. If the operator 30 is brought into contact with the RFID tag 22, however, the interruption 28 is bridged by an electrical conductor, causing the circuit 26 to become operative. The operator 30 may be coupled to a control device, such as, for example, a pushbutton or a switch, thereby allowing a user to enable or disable a particular RFID tag 22. Alternatively, the operator 30 may be coupled to a contactor so as to provide an indication of whether a particular circuit within the system is powered, or more generally, to indicate the operative state of the system.

Information regarding the state of the RFID state indicator 12 is collected electronically by the reader 16 by sending out a power/interrogation signal 18. If the power/interrogation signal 18 causes the antenna 24 to resonate, and if the antenna 24 is electrically coupled to the circuit 26, the electrical energy received by the antenna 24 will power the circuit 26, thereby inducing the circuit 26 to modulate its antenna with its coded information creating a reflected return signal 14 back to the reader 16. In response to each power/interrogation signal, therefore, all of the operative RFID state indicators 12 within communications range follow protocol instructions encoded in the power/interrogation signal and if requested send a return signal 14 that carries, among other things, identification information. If an RFID state indicator 12 responds with a return signal 14, the reader 16 is thereby informed that the particular RFID tag 22 corresponding with the transmitted identification information is operative, meaning that the particular input device coupled to the RFID tag 22, e.g. pushbutton, switch, etc., has been engaged. The information thus gained by the reader 16 can then be used to control some part of the control system 10. In other words, the detection of a return signal 14 with a particular identification code may indicate that a particular part of the control system 10, which corresponds with the identification code, should be engaged or disengaged (e.g., turned on or off.) It should be noted that, in embodiments of the present invention, the "on" state is signified by the detection of a return signal 14 from the RFID state indicator 12. In alternate embodiments, the "on" state is signified by the non-detection of a return signal 14 from the RFID state indicator 12.

Also included in the control system 10 is processing circuitry 36. In one embodiment, the processing circuitry 36 is used to control the reader 16. For example, the processing circuitry 36 may be used to adjust the frequency or intensity of the power/interrogation signal 18, to control a read-cycle rate of reader 16, or to trigger individual read cycles. Furthermore, processing circuitry may also be used to process the RFID state data received by the reader 16. For example, the reader 16 may send RFID state data to the processing circuitry 36 after each read cycle. The processing circuitry 36 may then respond to the RFID state data by initiating an electronic output that manipulates the control system 10 in accordance with the desired operational state as represented by the RFID state data received. The processing circuitry 36, therefore, includes a means of interpreting the RFID state data and associating the RFID state data with a desired operational state of control system 10. In this regard, the control system 10 may optionally include a memory 38 coupled to the processing circuitry 36. The memory 38 may, for example, contain a database that associates the identification information encoded in each RFID tag 22 with a particular controlled load 42. Additionally, although some or all of the programming logic by which the processing circuitry 36 operates could be hardwired into the processing circuitry 36, the memory 38 could also be used to hold a software program which determines, at least in part, how the processing circuitry 36 operates.

Also included in the control system 10 is driver circuitry 40. The driver circuitry 40 can include any means known in the art for powering components of a control or monitoring system. The driver circuitry 40 is electronically coupled to the processing circuitry 36, the load 42 and a state indicator 48, in this case an indicator light. The driver circuitry 40 receives an input signal from the processing circuitry 36 and optionally delivers a control signal to the load 42 and/or the indicator light 48, thereby powering the load 42 and/or the indicator light 48, depending on the state of the RFID state indicators 12. In the embodiment shown in FIG. 1, the load 42 includes a motor 46 and switch gear 44, such as, for example, a contactor. As stated above, however, the present invention is not limited to a particular type or combination of load components.

Embodiments of the present invention also include a network 34. The network 34 may include any type of communications network such as a local computer network. The network 34 can be used in conjunction with the processing circuitry 36, or as an alternate technique, for controlling the control system 10. For example, according to one embodiment, the reader 16 may send RFID state data to the network 34 through the interface 32. Some or all of the acquired RFID state data may then be routed to the processing circuitry 36 or to the processor 50. If the RFID state data is routed to the processor 50, the processor 50 then processes the state data and sends control signals to the driver 52, which, in turn, delivers load power or a control signal to the load 54, thereby turning the power supplied to the load 54 on or off depending on the user desire and the system programming, as indicated by the RFID state data. According to another embodiment of the present invention, software and configuration data can also be downloaded from the network 34 to the processing circuitry 36 or the processor 50. According to another embodiment, the network 34 is coupled to a computer system or other electronic device that includes a display, and RFID state data is used to display the current operational configuration of the control system 10.

It should be recognized that a control system in accordance with the present invention may take on a variety of configurations and include a wide variety of electrical devices, many of which are not depicted. For example, embodiments of the present invention may include several motors, switches, valves, pumps, indicator lights, alarms, breakers, etc. Additionally, some of the components depicted in FIG. 1 may not be necessary, such as the interface 32 or the network 34. The present invention is not intended, therefore, to be limited to the embodiment depicted in FIG. 1. In fact, RFID state indicators in accordance with the present invention can be adapted for use in any system that uses binary inputs or outputs.

Figure 2:
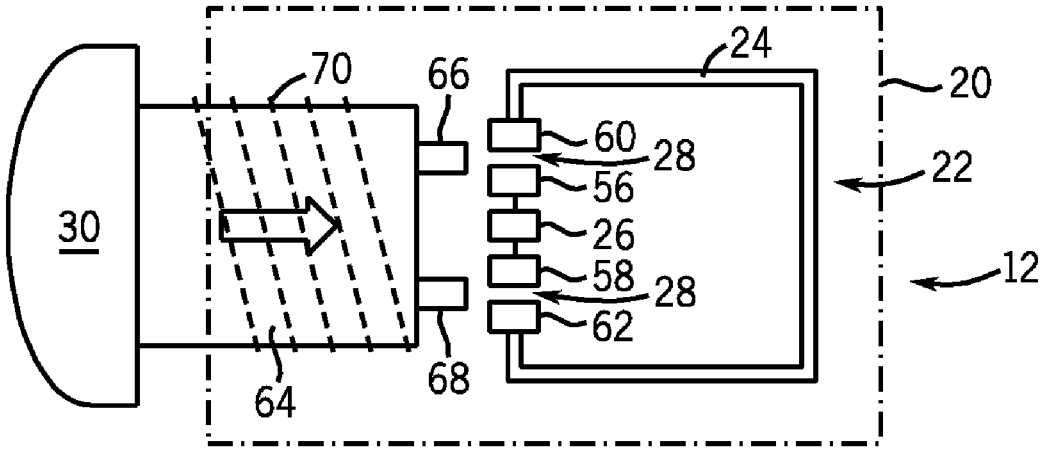
FIG. 2 is a schematic of an exemplary RFID state selector or indicator with a pushbutton actuator.
Figure 3:
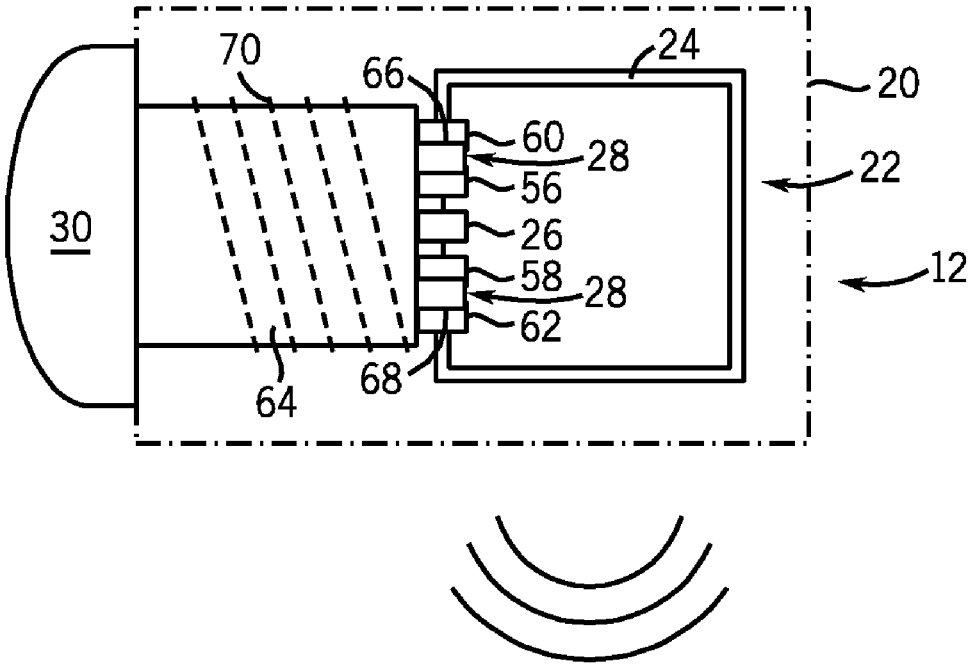
FIG. 3 is a schematic of an exemplary RFID state selector or indicator with a pushbutton actuator, wherein the pushbutton is pushed into contact with RFID tag.

Turning now to FIG. 2 and 3, an exemplary embodiment of an RFID state indicator is shown. FIG. 2 depicts an RFID state indicator 12 that includes a housing 20 an operator 30, and an RFID tag 22. The operator 30 is a pushbutton-style operator that includes a body 64, conductive extensions 66 and 68, and a biasing member 70, such as a spring, that biases the actuator 30 away from the RFID tag 22. The RFID tag 22 includes an antenna 24, electrical contact pads 56 and 68 separated by interruptions 28, and a circuit 26. In the embodiment shown in FIG. 2, the RFID tag 22 is inoperative because the interruption 28 prevents the antenna 24 from electrically coupling to the circuit 26. Because the RFID tag 22 is inoperative, the circuit 26 will not power up or send a return signal in response to a power/interrogation signal sent by an RFID tag reader. In the embodiment shown in FIG. 3, however, the operator 30 has been depressed, and the conductive extensions 66 and 68 have bridged the interruptions 28 between the electrical contact pads 56 and 58. Thus, the RFID tag 22 shown in FIG. 3 has become operative. Therefore, if an RFID reader sends a power/interrogation signal of the proper frequency, circuit 26 will send a return signal containing at least the identification information stored on the chip.

It should be recognized that in the embodiment shown in FIGS. 2 and 3, the lack of a return signal could indicate a disengaged pushbutton or a failure of the RFID tag 22 to operate properly. Therefore, depending on the specific application, it may be desirable to include a second RFID tag that will indicate the normal or disengaged position of the actuator 30. In this regard, an embodiment of the present invention may include a second RFID tag that is enabled when the actuator 30 is in the disengaged position shown in FIG. 2. With two RFID tags, a return signal will be expected whether the pushbutton is engaged or disengaged, and a failure to detect a return signal indicates a failure of an RFID tag or a failure to read an RFID tag, facilitating detection of failures.

RFID tags in accordance with the present invention may include various embodiments not depicted by FIGS. 2 and 3. Regarding the antenna 24, embodiments of the present invention may include any form of antenna known by those of ordinary skill in the art. For example, antenna 24 could be electrically and/or magnetically excited and may include one or more conductive loops, a conductive spiral, a conductive dipole or monopole, an inductor, a capacitor, or some combination thereof. The antenna 24 may also be printed or etched onto a substrate material or may be comprised of conductive wire. Additionally, the antenna 24 may include a material designed to alter the resonance characteristics of the antenna such as a ferromagnetic material. The design of the antenna 24 will be an ordinary engineering task involving the selection of a particular substrate, substance, geometry, etc. that is optimal for the particular design requirements that are chosen for a particular implementation of the present invention such as frequency, directionality, gain and power handling.

Additionally, embodiments of the present invention may include several alternative configurations for isolating the circuit 26 from the antenna 24. For example, in some embodiments, an electrical interruption is included on only one side of the circuit 26. Alternatively, one or more electrical interruptions may be placed at any position along the length of antenna 24. Additionally, in some embodiments, the interruptions 28 will be as close as possible to circuit 26 to lessen the degree of residual coupling that may occur due to the short conductive segments that may protrude from the circuit 26 depending on the location of the interruptions.

Furthermore, in addition to electrically isolating the circuit 26 from the antenna 24, embodiments of the present invention include an RFID tag 22 that is made inoperative by preventing the antenna 24 from resonating in response to the power/interrogation signal emitted by the reader 16. For example, the operator 30 may bring one or more additional conductors into proximity or contact with the antenna 24, thereby altering the resonant characteristics of the antenna 24 such that it will not effectively resonate at the frequency transmitted by the reader 16. In this way, the RFID tag 22 is disabled because the antenna 24 will not transmit electrical power to the circuit 26.

Additionally, RFID tags in accordance with the present invention may be normally operative or normally inoperative. In other words, if an RFID tag is normally operative, the circuit 26 and the antenna 24 will be electrically coupled and operative without the interposition of the operator 30, and the engagement of the operator 30 will disable the RFID tag in some way. On the other hand, if an RFID tag is normally inoperative, the circuit 26 and the antenna 24 will be electrically decoupled or, in some other way, disabled without the interposition of the operator 30, and the engagement of the operator 30 will enable the RFID tag.

Regarding the circuit 26, the circuit 26 can be any type of semiconductor circuit known in the art, such as, for example, a CMOS integrated circuit. Although the circuit 26 will ideally be passive, i.e. not requiring a power source other than the power/interrogation signal, the circuit 26 could optionally be active, or semi-passive. In other words, the circuit 26 could be fully or partially powered by a battery or some other power source other than the reader 16. Additionally, the circuit 26 may hold and transmit a range of useful information, such as, for example, RFID tag model, style, serial number, date of manufacture, physical location, etc. This data may then be used to maintain the RFID tags or replace RFID tags. For example, the data may be used to indicate the location of a particular RFID tag and whether a particular RFID tag is old or outdated or may need to be replaced as part of regular maintenance. To hold the data, the circuit 26 may include any form of electronic memory known in the art including read-only memory, writable memory or some combination of both.

Figure 4:
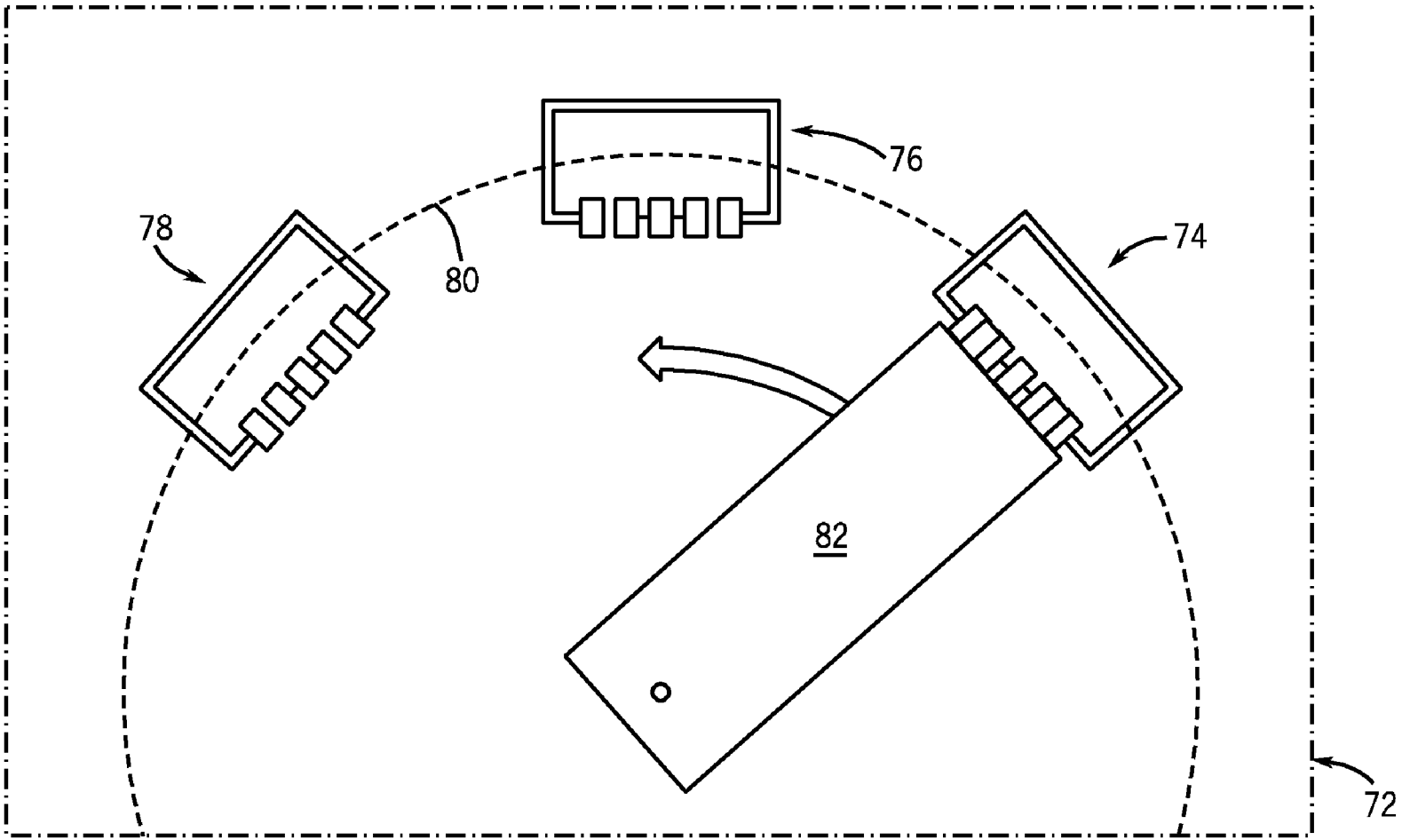
FIG. 4 is a schematic of an exemplary selector switch, wherein the selector switch can optionally make contact with one of three normally-open RFID tags.

Turning now to FIG. 4, an exemplary embodiment of a rotary device 72, in accordance with the present invention, is depicted. The rotary device 72 comprises three normally inoperative RFID tags 74, 76 and 78 aligned along an arc 80, and a rotary operator 82 anchored at the radial center of the arc 80. The operator 82 is rotatable, such that the conductive portions of the operator 82 selectively enable one of the RFID tags 74, 76, or 78. The operator 82, may be human operated, or may be mechanically coupled to another rotating element (not depicted) whose position is to be determined by the rotary device 72. The operator 82 may also include one or more detent mechanisms to hold the operator 82 more securely in contact with one of the RFID tags 74, 76 or 78. Additionally, the rotary device 72 may include any number of RFID tags aligned along the arc 80. In embodiments of the present invention, the rotary device 72 includes one or more additional arcs, not depicted, along which additional RFID tags are aligned. The additional RFID tags may be staggered radially so that only one RFID tag is enabled for any position of operator 82, or the additional RFID tags may be radially aligned so that more than one RFID tag is enabled for a particular position of operator 82.

Figure 5:
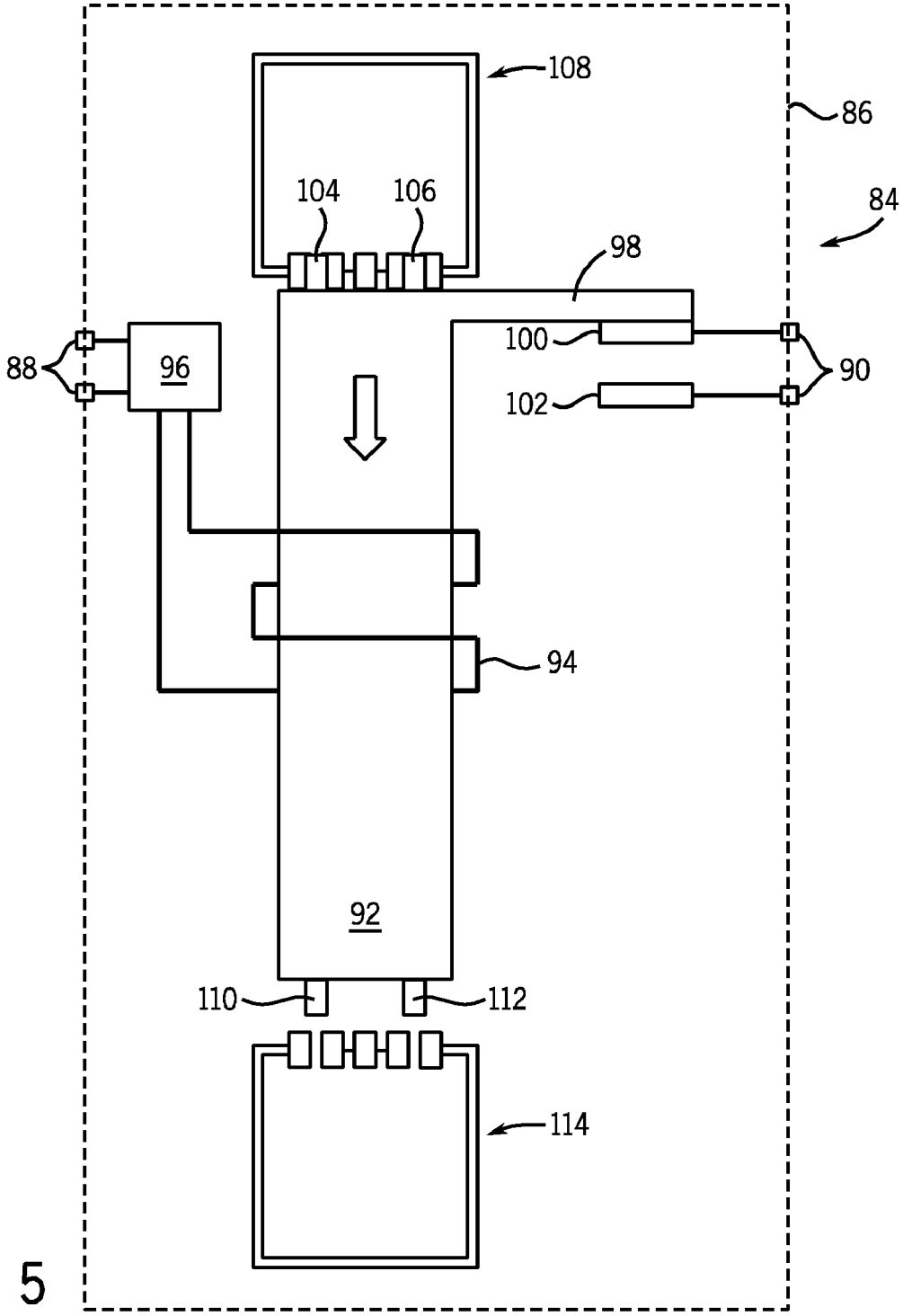
FIG. 5 is a schematic of an auxiliary signal device, wherein an actuator makes contact with one of two normally-open RFID tags.

Turning now to FIG. 5, an exemplary embodiment of an auxiliary signal device 84 is depicted. The auxiliary signal device 84 may be a relay, contactor, disconnect switch or any other device that controls a primary current path via an input signal. The auxiliary signal device 84 includes a control terminal 88 coupled to a controller 96, which controls the position of an operator 92 by inducing a current flow in a coil 94. The auxiliary signal device 84 also includes a moveable contact 100 connected to an operator 92 through a linkage 98, such that movement of the operator 92, will bring the moveable contact 100 into contact with a stationary contact 102, thereby completing an electrical path between a set of output terminals 90.

Also included in the auxiliary signal device 84 are two normally inoperative RFID tags 108 and 114. Depending on the position of the operator 92, RFID tag 108 is made operative by conductive extensions 104 and 106, or RFID tag 114 is made operative by conductive extensions 110 and 112. As depicted in FIG. 5, the current position of the operator 92 is such that RFID 108 is operative and RFID tag 114 is inoperative. In the embodiment depicted in FIG. 5, a power/interrogation signal from an RFID tag reader would power RFID tag 108, and RFID tag 108 would send a return signal, while RFID tag 114 would remain silent. The return signal will, therefore, indicate that auxiliary signal device 84 is off, i.e. output terminals 90 are decoupled. If a control signal is applied to the control terminals 88, the operator 92 will move downward, bringing the movable contact 100 into contact with the stationary contact 102, completing the circuit between the terminals 90. Furthermore, conductive extensions 104 and 106 will move out of contact with RFID tag 108, disabling RFID tag 108, and conductive extensions 110 and 112 will move into contact with RFID tag 114, enabling RFID tag 114. With this new actuator position, a power/interrogation signal from an RFID tag reader will power RFID tag 114, and RFID tag 114 will send a return signal, while RFID tag 108 will remain silent. The return signal will, therefore, indicate that auxiliary signal device 84 is on, i.e. output terminals 90 are coupled.

In certain embodiments of the present invention, the auxiliary signal device 84 includes only one RFID tag, wherein the enablement of the RFID tag indicates one actuator position and the disablement of the RFID tag indicates the opposite position. Using one RFID tag may, however, lead to uncertainty about whether the lack of a return signal was due to the disablement of the RFID tag or failure of the RFID tag to operate properly. Therefore, the use of two RFID tags, as depicted in FIG. 5, provides a higher level of assurance of the state of auxiliary signal device 84, because at least one return signal will always be expected and the lack of a return signal will generally result from device failure or a failure to read either RFID tag.

Figure 7:
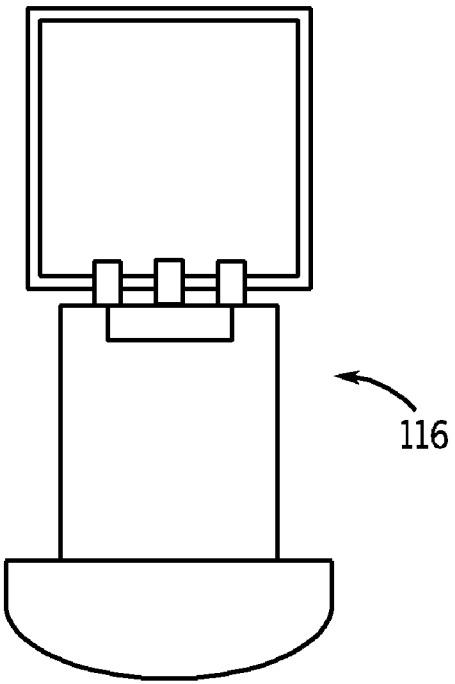
FIG. 7 is a schematic of a short circuiting RFID tag in a short circuited configuration.
Figure 6:
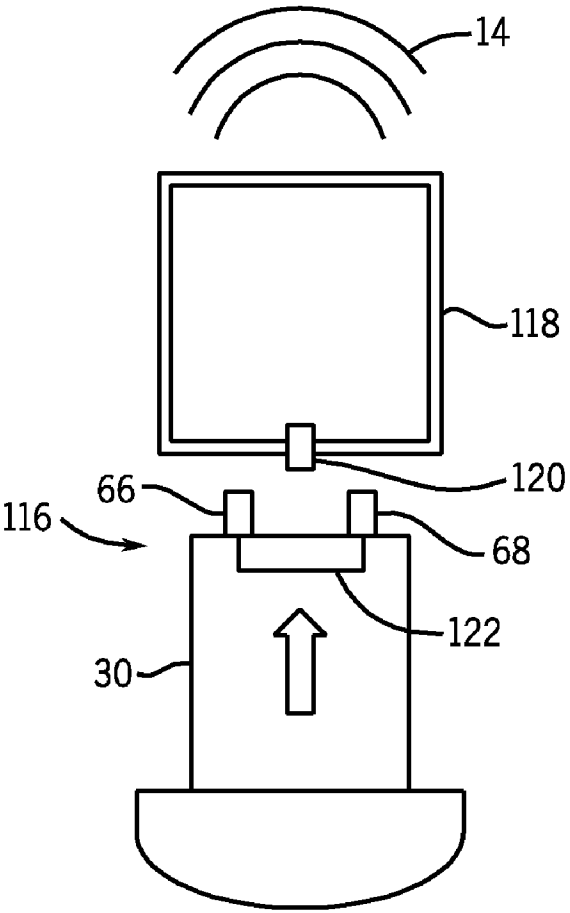
FIG. 6 is a schematic of a short circuiting RFID tag in a transmitting configuration.

Turning now to FIGS. 6 and 7, an embodiment of a short-circuiting RFID state indicator 116 is shown. The short-circuiting RFID state indicator 116 includes an RFID tag with a circuit 120 and an antenna 118. Because the electrical coupling between the antenna 118 and the circuit 120 is built into the RFID tag, the RFID tag is normally operative and thus does not require the interposition of a conductive element to be enabled. Also included in the short-circuiting RFID state indicator 116 is an operator 30 that includes conductive extensions 66 and 68 and a conductive link 122. As long as the operator 30 remains disengaged, the RFID tag will remain operative and will, therefore, send a return signal 14. If, however, the operator 30 is moved into contact with an exposed conductive portion of the antenna 118 of the RFID tag, as shown in FIG. 7, the conductive extensions 66 and 68 and the conductive link 122 will create a short circuit across the circuit 120, thereby decoupling the antenna 118 from the circuit 120. As discussed above, other means of disabling an RFID tag may be envisioned. For example, in embodiments of the present invention the interposition of an operator serves to shield the antenna 118. In other embodiments, the interposition of an operator changes the geometry and hence the resonance characteristics of the antenna 118 such that it no longer effectively resonates at the frequency emitted by the reader. In another embodiment, the conductive elements 66 and 68 and conductive link 122 are placed permanently on the tag instead of on the operator and the conductive link 122 is composed of a magnetic reed switch that selectively enables and disables the RFID tag by movement of a magnet carried on the tag end of the operator.

As described above, the device of the invention allows for altering performance of the antenna and/or of the circuit coupled or couplable to the antenna so that the reader or interrogator may read or be prevented from reading the data in the circuit, and thereby gather an indication of the state of the device (e.g., position of the operator). As noted above, this may be done in a variety of manners. For example, the operator may complete or interrupt a conductive path defining the antenna (e.g., making or breaking a loop forming the antenna), or may short or unshort the antenna (e.g., connect or disconnect the antenna with another component or conductive path). Because the antenna operates by returning a signal to the interrogator, the operator may alter an electromagnetic property of the antenna to allow or prevent such transmission, or may shield or unshield the antenna, or change a resonant frequency of the antenna. Moreover, two or more such antenna may be utilized to provide a multi-state device in which signals from one circuit available from one antenna indicate a first state, and signals from a further circuit available from another antenna indicate a second state.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A wireless input device comprising:

a first radio frequency antenna;

a first data storage circuit couplable to the first antenna;

a second radio frequency antenna;

a second data storage couplable to the second antenna; and an operator movable with respect to the first antenna and second antenna for altering operation of the first antenna and the second antenna and the first circuit and the second circuit to enable the antennas to communicate signals in accordance with data stored on the respective data storage circuit.

2. The device of claim 1, wherein the operator completes or interrupts a conductive path defining the first or second antenna.

3. The device of claim 1, wherein the operator shorts or unshorts the first or second antenna.

4. The device of claim 1, wherein the operator alters an electromagnetic property of the first or second antenna.

5. The device of claim 1, wherein the operator shields or unshields the first or second antenna.

6. The device of claim 1, wherein the operator changes a resonant frequency of the first or second antenna.

7. The device of claim 1, wherein the first or second data storage circuit is separated from the first or second antenna, respectively, by a gap and wherein the operator includes a body and a mechanism to engage a conductive portion that spans the gap to complete the conductive path.

8. The device of claim 7, wherein the first or second data storage circuit is separated from the first or second antenna, respectively, by a plurality of gaps and wherein the operator engages a corresponding number of conductive portions that span the respective gaps to complete the conductive path.

9. The device of claim 1, wherein the operator is movable linearly towards and away from the first and second antenna and the first and second circuit.

10. The device of claim 1, comprising a plurality of additional antennas and a plurality of additional respective data storage circuits.

11. The device of claim 10, wherein the operator is rotatable with respect to the respective antennas for selectively completing and interrupting a conductive path between one antenna and a respective circuit at any one time.

12. The device of claim 10, wherein the operator includes a plurality of conductive portions at ends thereof, and wherein the operator is movable linearly with respect to the respective antennas and circuits for completing and interrupting a conductive path between one antenna and a respective circuit at any one time.

13. The device of claim 1, wherein the first antenna is enabled when the second antenna is disabled, and the second antenna is enabled when the first antenna is disabled.

14. A wireless input device comprising:

a radio frequency antenna;

a data storage circuit couplable to the antenna; and an operator movable with respect to the antenna for affecting a connection between the antenna and the circuit to selectively enable the antenna to communicate signals in accordance with data stored on the circuit and to disable the antenna from communicating the signals, wherein the circuit and antenna are configured to be powered by a read signal transmitted by a radio frequency reader.

15. The device of claim 14, wherein the operator completes and interrupts a conductive path between the antenna and the circuit to allow the antenna to communicate signals and to interrupt the communication of signals, respectively.

16. The device of claim 14, wherein the antenna and the circuit are electrically coupled to one another, and wherein the operator establishes an alternative current path around the circuit to interrupt the communication of signals.

17. The device of claim 14, wherein the antenna and the circuit are electrically coupled to one another, and wherein the operator alters a characteristic of the antenna to interrupt the communication of signals.

18. The device of claim 14, wherein the operator is movable linearly towards and away from the antenna and circuit.

19. The device of claim 14, wherein the operator is rotatable with respect to the antenna and circuit.

20. The device of claim 14, comprising a plurality of antennas and a plurality of respective data storage circuits.

21. An electrical system configured to receive an input signal comprising:

an input device including a radio frequency antenna, a data storage circuit couplable to the antenna, and an operator movable with respect to the antenna for affecting a connection between the antenna and the circuit to selectively enable the antenna to communicate signals in accordance with data stored on the circuit and to disable the antenna from communicating the signals;

a radio frequency reader configured to receive signals from the input device; and processing circuitry coupled to the reader and configured to provide an output signal to drive circuitry for driving an electrical load based upon the received signals.

22. The system of claim 21, wherein the reader transmits a read signal to the input device, and wherein the circuit and antenna are powered by the read signal.

23. The system of claim 21, wherein the reader is coupled to the processing circuitry remotely via a network.

24. The system of claim 21, wherein the drive circuitry includes electrical switchgear for driving a motor.

25. The system of claim 21, wherein the load includes a human perceivable indicator of a state of an actuator.

26. A wireless input device comprising:

a radio frequency antenna;

a data storage circuit couplable to the antenna; and an operator rotatable with respect to the antenna and the data storage circuit for selectively completing and interrupting a conductive path between the antenna and the circuit to selectively enable the antenna to communicate signals in accordance with data stored on the circuit and to disable the antenna from communicating the signals.

* * * * *